US008205714B2

(12) United States Patent
Schuermans et al.

(10) Patent No.: US 8,205,714 B2
(45) Date of Patent: Jun. 26, 2012

(54) METHOD FOR ADJUSTING A HELMHOLTZ RESONATOR AND AN ADJUSTABLE HELMHOLTZ RESONATOR

(75) Inventors: Bruno Schuermans, La Tour de Peilz (CH); Jaan Hellat, Baden-Rütihof (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 13/022,923

(22) Filed: Feb. 8, 2011

(65) Prior Publication Data

US 2011/0139541 A1 Jun. 16, 2011

Related U.S. Application Data

(63) Continuation of application No. PCT/EP2009/059872, filed on Jul. 30, 2009.

(30) Foreign Application Priority Data

Aug. 14, 2008 (CH) ..... 1279/08

(51) Int. Cl.
*F01N 1/02* (2006.01)

(52) U.S. Cl. ..... 181/212; 181/213

(58) Field of Classification Search ..... 181/210, 181/212, 213; 60/39.77
See application file for complete search history.

(56) References Cited

U.S. PATENT DOCUMENTS

| | | | | |
|---|---|---|---|---|
| 5,968,378 | A * | 10/1999 | Jensen | 219/121.43 |
| 6,981,358 | B2 * | 1/2006 | Bellucci et al. | 60/39.17 |
| 2005/0106519 | A1 * | 5/2005 | Flohr et al. | 431/114 |
| 2007/0292261 | A1 * | 12/2007 | Tang et al. | 415/119 |

FOREIGN PATENT DOCUMENTS

| | | |
|---|---|---|
| DE | 4414232 | 10/1995 |
| DE | 19640980 | 4/1998 |
| DE | 102004007717 | 9/2004 |
| DE | 102005062284 | 1/2008 |
| EP | 0111336 | 6/1984 |
| EP | 1213538 | 6/2002 |
| EP | 1624250 | 2/2006 |
| EP | 1624251 | 2/2006 |
| WO | W02010/018069 | 2/2010 |

OTHER PUBLICATIONS

Search Report for Swiss Patent App. No. 01279/2008 (Nov. 23, 2008).

* cited by examiner

*Primary Examiner* — Jeremy Luks
(74) *Attorney, Agent, or Firm* — Cermak Nakajima LLP; Adam J. Cermak

(57) ABSTRACT

In a method for adjusting a Helmholtz resonator (10), in which a resonator volume (11) is connected to a space (13) to be provided with damping along an axis (29) via a constriction (12) having an acoustic impedance, the acoustic impedance of the constriction (12) is altered in order to adjust the Helmholtz resonator (10).

17 Claims, 3 Drawing Sheets

METHOD FOR ADJUSTING A HELMHOLTZ RESONATOR AND AN ADJUSTABLE HELMHOLTZ RESONATOR

This application is a Continuation of, and claims priority under 35 U.S.C. §120 to, International application no. PCT/EP2009/059872, filed 30 Jul. 2009, and claims priority therethrough under 35 U.S.C. §§119, 365 to Swiss application no. No. 01279/08, filed 14 Aug. 2008, the entireties of which are incorporated by reference herein.

BACKGROUND

1. Field of Endeavor

The present invention relates to the field of combustion engineering, in particular in connection with gas turbines. It relates to a method for adjusting a Helmholtz resonator in and to an adjustable Helmholtz resonator.

2. Brief Description of the Related Art

The use of Helmholtz resonators for damping pulsations in the combustion chambers of gas turbines has already been proposed a number of times (see, for example, DE-B4-196 40 980). Helmholtz resonators with a plurality of resonator volumes connected one behind the other, with which multiple frequencies can be damped, have also already been disclosed (see, for example, DE-A1-10 2005 062 284).

The effectiveness of such damping systems is restricted to a narrow frequency range around the resonant frequency of the individual dampers. The damping characteristic of such systems is a function of the acoustic impedance of the constriction used to couple the respective resonator volume to the space to be provided with damping, in particular the combustion chamber of a gas turbine. The acoustic impedance of the constriction for its part is a function of the flow rate and the pressure loss coefficient in the constriction. For Helmholtz resonators with only one resonator volume, the resonant frequency is only weakly dependent on the acoustic impedance in the constriction. For two resonator volumes, however, the resonant frequency is highly dependent on this impedance.

In general, it is desirable to have a Helmholtz resonator which can be matched to the pulsations actually occurring in a combustion chamber in order to achieve the greatest possible damping effect. In the aforementioned DE-A1-10 2005 062 284, this can be achieved, for example, by virtue of the fact that an adjustable plunger is arranged in the resonator volume. Such a mechanical adjustment is complex in terms of construction, however, and is poorly suited to active regulation.

SUMMARY

One of numerous aspects of the present invention includes a method for adjusting a Helmholtz resonator which enables simple and easily controllable matching of the Helmholtz resonator and to provide a Helmholtz resonator for carrying out the method.

Another aspect includes that, in order to adjust the Helmholtz resonator, the acoustic impedance of the constriction via which the resonator volume is connected to the space to be provided with damping is altered. The adjustment of the acoustic impedance of the constriction makes it possible:

1) To match the resonator impedance in the case of a Helmholtz resonator with only one resonator volume (and therefore to optimally match the damping response of the resonator).

2) To match the resonant frequency and the impedance in the case of Helmholtz resonators with two resonator volumes.

The acoustic impedance of the constriction can be adjusted in two ways:

1) By injecting scavenging air via two air inlets (air nozzles) into the resonator system, to be precise via an axial air inlet, via which the air is injected in the direction of the (longitudinal) axis of the resonator arrangement, and via a tangential air inlet, via which the air is injected in the circumferential direction, with respect to the axis. The ratio of the pulses of the tangentially injected air and the axially injected air defines the swirl number in the resonator volume and in the constriction. The acoustic impedance in the constriction is in this case a function of the swirl number.
2) By using a vortex generator at the upstream end of the constriction. The turbulent flow thus resulting in the constriction, followed by a sudden expansion at the outward opening of the constriction, displays in a known manner a so-called vortex breakdown. It is known that the mechanism of the vortex breakdown indicates a strong dependence of the pressure loss coefficient on the swirl number. The swirl number can in this case be adjusted by a small proportion of axial air injected into the constriction.

Another aspect of a method in accordance with principles of the present invention therefore includes that the acoustic impedance of the constriction is altered by altering the swirl number in the resonator volume and in the constriction.

In particular, for this purpose, axial air is injected into the at least one resonator volume in the direction of the axis and tangential air is injected into the at least one resonator volume in the circumferential direction with respect to the axis, and, in order to alter the swirl number, the ratio of the mass flows of axial air and tangential air is altered.

Another aspect of a method according to principles of the present invention includes that axial air is injected into the at least one resonator volume in the direction of the axis and tangential air is injected into the at least one resonator volume in the circumferential direction with respect to the axis, that the axial air is applied to a vortex generator arranged at the upstream end of the constriction, and that, in order to alter the swirl number, the mass flow of the axial air is altered.

The ratio between the mass flows of axial air and tangential air can be controlled in three different ways:

1) By altering the flow cross sections of the axial air and tangential air inlets. Owing to the fact that the pressure drop across the damper is fixed, the mass flows are proportional to the flow cross sections of the inlets.
2) By valves (control valves).
3) By a fluidic control device (a so-called 'fluidix element'). Such an element is the fluid-dynamic equivalent of a transistor: it uses a small amount of air for controlling the main air flow. Such a fluidix element can in this case be an integral part of the Helmholtz resonator or of the vortex generator used there.

The possibility provided by devices and methods embodying principles of the present invention of matching the frequency and the impedance of the Helmholtz resonator can be used in a closed control loop for regulating the pulsation intensity in the combustion chamber of the gas turbine. Such a system would include an adaptable Helmholtz resonator and a controller, which specifies the ratio of tangential air to radial air. The controller fixes this ratio in accordance with a measured pulsation frequency and amplitude.

Another aspect of a method according to principles of the present invention therefore includes that the acoustic impedance of the constriction is altered in accordance with a pulsation signal measured in the space to be provided with damping.

An exemplary Helmholtz resonator according to principles of the present invention includes at least one resonator volume which can be connected to the space to be provided with damping, in particular to the combustion chamber, along an axis via a constriction, wherein the constriction has a predetermined acoustic impedance, and the Helmholtz resonator includes means for adjusting the acoustic impedance of the constriction.

A first configuration of a Helmholtz resonator according to principles of the present invention is characterized by the fact that the means for adjusting the acoustic impedance of the constriction includes an axial air inlet for injecting air in the direction of the axis and a tangential air inlet for injecting air in the circumferential direction with respect to the axis.

In particular, the acoustic impedance of the constriction can be altered via the swirl number by altering the ratio of the air injected through the axial air inlet and the air injected through the tangential air inlet.

Another aspect includes that the flow cross section of the axial air inlet and/or of the tangential air inlet can be altered.

Another aspect includes that, in order to alter the ratio of the air injected through the axial air inlet to the air injected through the tangential air inlet, at least one control valve is provided.

A further aspect includes that, in order to alter the ratio of the air injected through the axial air inlet to the air injected through the tangential air inlet, a fluidic control device is provided.

Preferably, in order to drive the at least one control valve or the fluidic control device, a controller is provided, with it being possible for a pulsation signal, which is measured in the space to be provided with damping, in particular in the combustion chamber, to be applied to an input of said controller.

Another embodiment of a Helmholtz resonator according to principles of the present invention can be characterized by the fact that the acoustic impedance of the constriction can be altered via the swirl number by a vortex generator, which is arranged at the upstream end of the constriction and to which axially injected air can be applied via the axial air inlet.

One variant of a Helmholtz resonator according to principles of the present invention can be characterized by the fact that the Helmholtz resonator has a single resonator volume, that the axial air inlet is arranged on that side of the resonator volume which is opposite the constriction, and that the tangential air inlet injects air into the resonator volume approximately in the center between the constriction and the axial air inlet.

Another variant of a Helmholtz resonator according to principles of the present invention can be characterized by the fact that the Helmholtz resonator includes at least two resonator volumes with two associated constrictions, the resonator volumes being connected one behind the other along the axis, and that at least the first resonator volume has an axial air inlet for injecting air in the direction of the axis and a tangential air inlet for injecting air in a circumferential direction with respect to the axis.

In particular, in this case it is also possible for the second resonator volume to have an axial air inlet for injecting air in the direction of the axis and a tangential air inlet for injecting air in the circumferential direction with respect to the axis.

Likewise, both resonator volumes can have a vortex generator, which is arranged at the upstream end of the constriction.

BRIEF DESCRIPTION OF THE DRAWINGS

The invention will be explained in more detail below with reference to exemplary embodiments in connection with the drawing, in which.

DETAILED DESCRIPTION OF EXEMPLARY EMBODIMENTS

Figure 1:
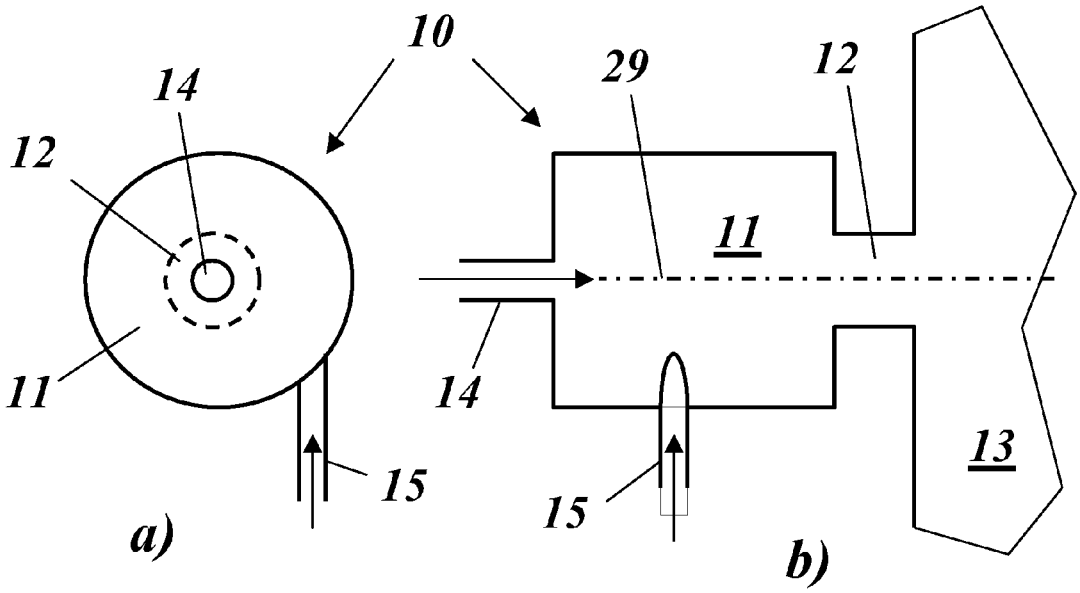
FIG. 1 shows a very simplified basic illustration of an adjustable Helmholtz resonator in accordance with a first exemplary embodiment of the invention with only one resonator volume, in a plan view in the direction of the axis (a) and in the side view (b)

FIG. 1 shows a very simplified basic illustration of an adjustable Helmholtz resonator in accordance with a first exemplary embodiment of the invention in a view along the axis 29 of the system (FIG. 1(*a*)) and in a side view (FIG. 1(*b*)). The Helmholtz resonator 10 has a resonator volume 11, which is connected to a space to be provided with damping, in this case the combustion chamber 13 of a gas turbine (not illustrated), via a constriction 12. The Helmholtz resonator 10 extends along the axis 29. The resonator volume 11 and the constriction 12 can have a cylindrical configuration. Other configurations are also conceivable. In particular, the constriction can be in the form of a converging tube in order to intensify any possible vortex breakdown. The dimensions depend on the pulsation frequencies occurring in the combustion chamber.

In order to adjust the acoustic impedance in the constriction 12, two air inlets 14 and 15 are provided in the resonator volume 11. Air is injected into the resonator volume 11 in the axial direction via the axial air inlet 14 arranged opposite the constriction 12. Air is injected into the resonator volume 11 in a tangential direction through the tangential air inlet 15 which is arranged approximately centrally laterally between the axial air inlet 14 and the constriction 12. The ratio of the pulses of the injected axial air and tangential air determines the swirl number in the resonator volume 11 and in the constriction 12 and therefore the acoustic impedance in the constriction 12, with this acoustic impedance being dependent on the swirl number. The pulse ratio of the axial air to the tangential air can be altered, for example, by virtue of the fact that the flow cross section in the axial air inlet 14 and/or in the tangential air inlet 15 is altered. This can take place, for example, by diaphragms with different opening diameters being inserted or by (iris) diaphragms with variable diameters.

Figure 2:
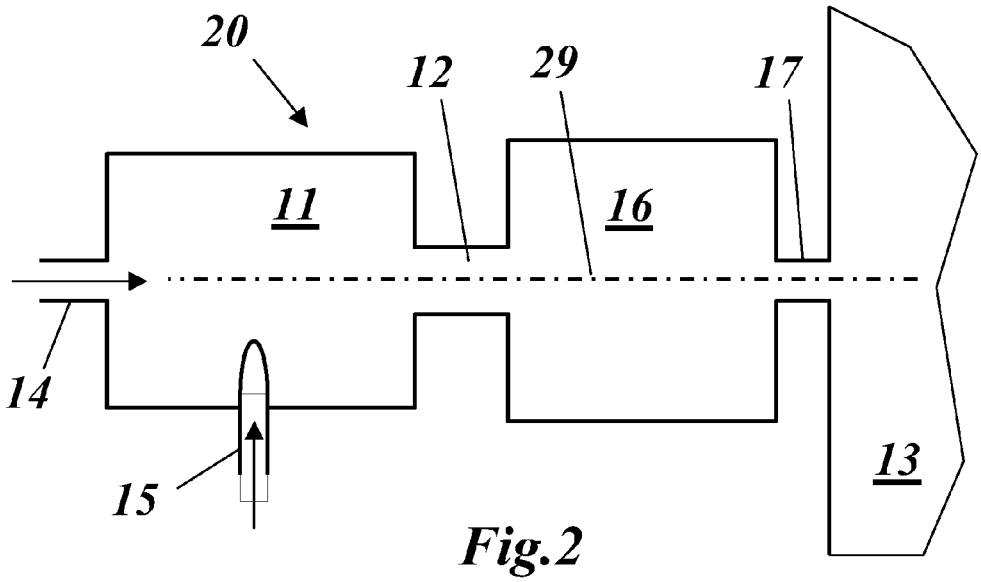
FIG. 2 shows an illustration comparable to that in FIG. 1(*b*) of an adjustable Helmholtz resonator in accordance with a second exemplary embodiment of the invention with two resonator volumes arranged one behind the other in the axial direction, with it only being possible to adjust the properties of the first resonator volume.

Instead of only one resonator volume, however, it is also possible for two resonator volumes connected one behind the other in the axial direction to be provided. A first exemplary embodiment of a Helmholtz resonator in accordance with the invention with two resonator volumes is shown in FIG. 2. In the Helmholtz resonator 20 shown in FIG. 2, a second resonator volume 16 with a second constriction 17 is arranged between the first resonator volume 11 with the downstream first constriction 12 and the combustion chamber 13. In this case, the matching in turn takes place by an axial air inlet 14 and a tangential air inlet 15 at the first resonator volume 11. The two resonator volumes 11, 16 and constrictions 12, 17 can be identical in terms of size and configuration. However, it is also conceivable for them to differ from one another in terms of both aspects, as is indicated in FIG. 2. Likewise, in addition to the resonator volume 11, the resonator volume 16 can also be equipped with an axial air inlet and a tangential air inlet, as is indicated by the dashed lines with the reference symbols 15' and 18' in FIG. 3.

Figure 3:
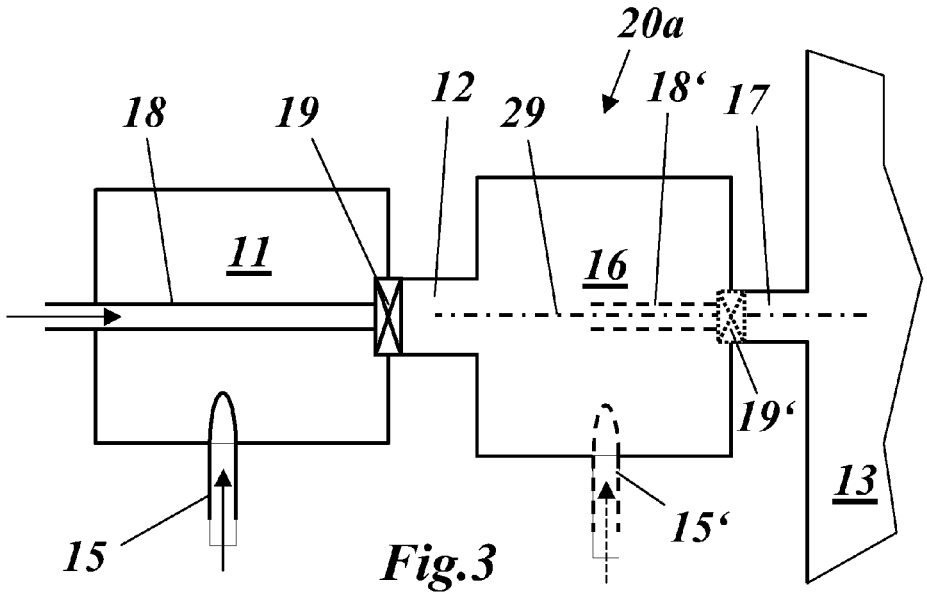
FIG. 3 shows an illustration comparable to that in FIG. 2 of an adjustable Helmholtz resonator in accordance with a third exemplary embodiment of the invention with two resonator volumes arranged one behind the other in the axial direction, wherein a vortex generator to which axial air can be applied is arranged at the constriction of the first resonator volume.

The Helmholtz resonator 20*a* shown in FIG. 3 represents a modification of the Helmholtz resonator 20 shown in FIG. 2. It likewise includes two resonance volumes 11 and 16 connected one behind the other with the corresponding constrictions 12 and 17. As a deviation from the arrangement shown in FIG. 2, in this case a vortex generator ("swirler") 19 is provided at the upstream end of the first constriction 12, with axial air being applied to this vortex generator via a comparatively narrow axial air inlet 18. By virtue of the effect of vortex breakdown, the swirl number can be influenced by this axial air. The second resonator volume 16 can also be equipped with an axial air inlet 18' and a tangential air inlet 15' and/or with a vortex generator 19'.

Figure 4:
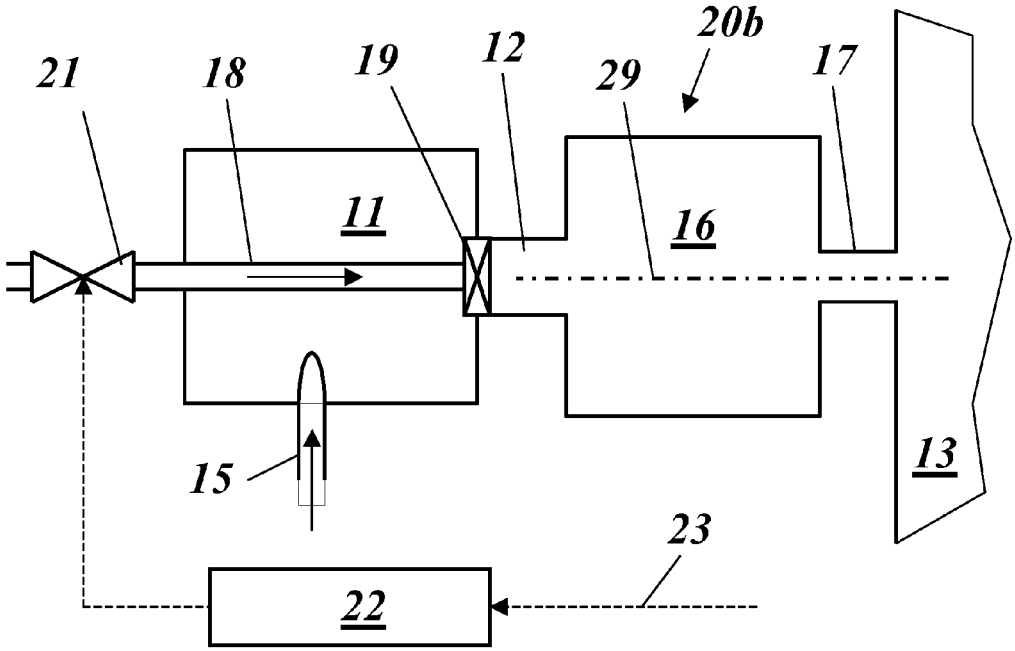
FIG. 4 shows a fourth exemplary embodiment of the invention, which is similar to that in FIG. 3, in which the axial air for the vortex generator is controlled via a control valve in accordance with a pulsation signal.
Figure 5:
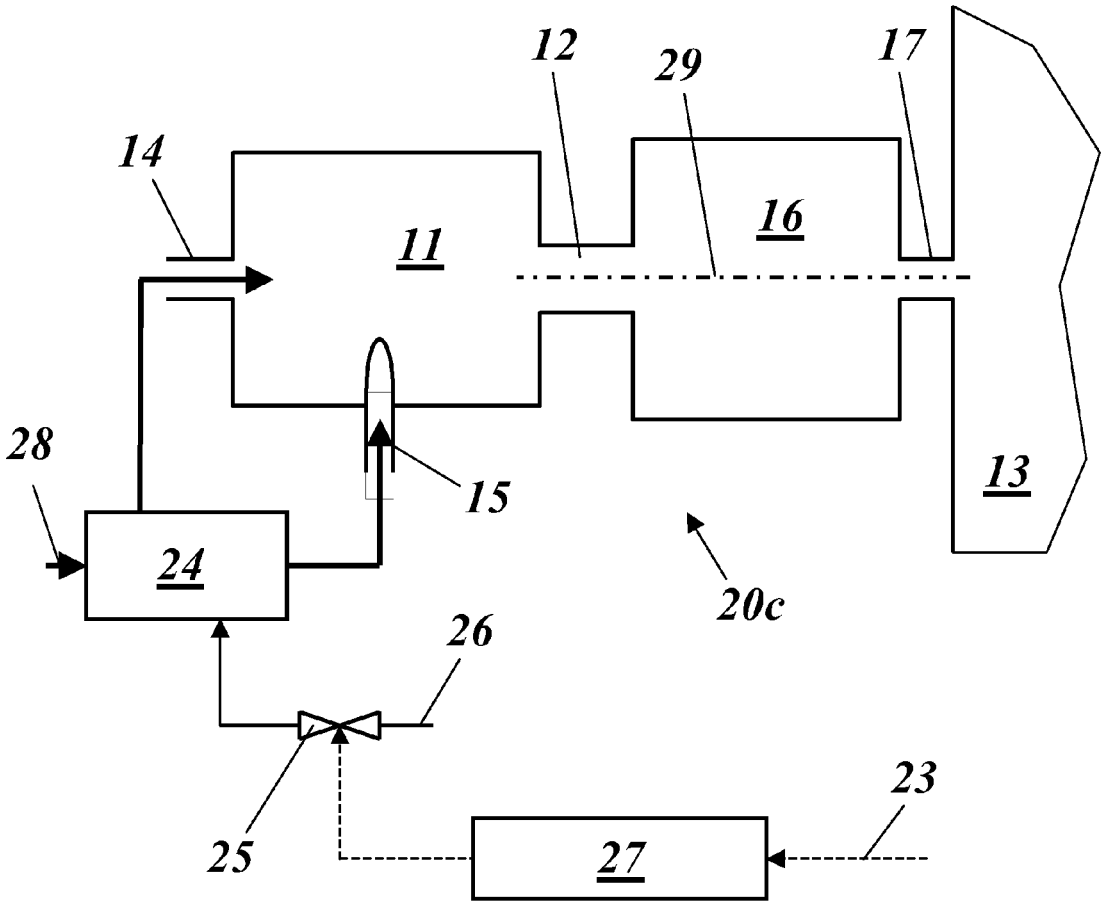
FIG. 5 shows a fifth exemplary embodiment, similar to that in FIG. 2, in which the axial air and the tangential air are controlled via a fluidic control device in accordance with a pulsation signal.

A Helmholtz resonator according to principles of the present invention can be part of a closed control loop, as is illustrated in FIGS. 4 and 5. In the exemplary embodiment in FIG. 4, the Helmholtz resonator 20*b* in turn has two resonator volumes 11 and 16 connected one behind the other with the associated constrictions 12 and 17. For adjustment purposes, a vortex generator 19 is provided with an axial air inlet 18 and a tangential air inlet 15. The mass flow of the axial air can be controlled by a control valve 21 arranged in front of the axial air inlet 18. The control valve 21 is driven by a controller 22, which receives a pulsation signal accommodated in the combustion chamber 13 as the input side. The algorithm of the controller 22 in this case attempts to reduce the size of the pulsations.

In the exemplary embodiment shown in FIG. 5, the mass flows of the axial air and the tangential air are controlled by a fluidic control device (fluidix element) 24 in accordance with a small flow of control air 26. The air is supplied and correspondingly distributed via an air supply line 28. The control air 26 is controlled by a control valve 25, which for its part is controlled by a controller 27 in accordance with a pulsation signal 23 from the combustion chamber 13.

Helmholtz resonators according to principles of the present invention can advantageously be used for damping purposes in the combustion chambers of gas turbines, wherein the adjustment of the systems to the pulsations occurring in the combustion chambers can take place in the manner described above or takes place automatically in a control loop.

LIST OF REFERENCE SYMBOLS

10,20 Helmholtz resonator
20*a*,*b*,*c* Helmholtz resonator
11,16 Resonator volumes
12,17 Constriction
13 Combustion chamber (gas turbine etc.)
14,18,18' Axial air inlet
15,15' Tangential air inlet
19,19' Vortex generator
21,25 Control valve
22,27 Controller
23 Pulsation signal (measured)
24 Fluidic control device
26 Control air
28 Air supply line
29 Axis While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A method for adjusting a Helmholtz resonator, which resonator includes at least one resonator volume having a swirl number and being connected to a space to be provided with damping along an axis via a constriction having an acoustic impedance, the method comprising:

altering the acoustic impedance of the constriction, including altering the swirl number in the resonator volume and in the constriction, axially injecting air into the at least one resonator volume, and injecting air tangentially into the at least one resonator volume in a circumferential direction with respect to the axis; and wherein altering the swirl number comprises altering a ratio of the mass flows of axial air and tangential air.

2. A method for adjusting a Helmholtz resonator, which resonator includes at least one resonator volume having a swirl number and being connected to a space to be provided with damping along an axis via a constriction having an acoustic impedance, the method comprising:

altering the acoustic impedance of the constriction, including altering the swirl number in the resonator volume and in the constriction, axially injecting air into the at least one resonator volume, and injecting air tangentially into the at least one resonator volume in a circumferential direction with respect to the axis; and wherein axially injecting air comprises injecting air to a vortex generator arranged at an upstream end of the constriction; and wherein altering the swirl number comprises altering the mass flow of air of said axially injecting air.

3. The method as claimed in claim 1, further comprising:

measuring a pulsation signal in said space; and wherein altering the acoustic impedance of the constriction comprises altering based on the pulsation signal.

4. The method as claimed in claim 2, further comprising:

measuring a pulsation signal in said space; and wherein altering the acoustic impedance of the constriction comprises altering based on the pulsation signal.

5. A Helmholtz resonator comprising:

at least one resonator volume configured and arranged to be connected to a space to be provided with damping, and a constriction in communication with the at least one resonator volume along an axis, wherein the constriction has a predetermined acoustic impedance and a swirl number; and means for adjusting the acoustic impedance of the constriction including an axial air inlet configured and arranged to inject air in the direction of the axis, and a tangential air inlet configured and arranged to inject air in a circumferential direction with respect to the axis.

6. The Helmholtz resonator as claimed in claim 5, wherein the constriction is configured and arranged so that the acoustic impedance of the constriction can be altered via the swirl number by altering a ratio of air injected through the axial air inlet and air injected through the tangential air inlet.

7. The Helmholtz resonator as claimed in claim 6, wherein the axial air inlet, the tangential air inlet, or both are configured and arranged so that a flow cross section of the axial air inlet, of the tangential air inlet, or of both can be altered.

8. The Helmholtz resonator as claimed in claim 6, further comprising:

at least one control valve configured and arranged to alter a ratio of air injected through the axial air inlet to air injected through the tangential air inlet.

9. The Helmholtz resonator as claimed in claim 6, further comprising:

a fluidic control device configured and arranged to alter a ratio of air injected through the axial air inlet to air injected through the tangential air inlet.

10. The Helmholtz resonator as claimed in claim 8, further comprising:

a controller configured and arranged to drive the at least one control valve, the controller being configured and arranged to receive an input pulsation signal measured in said space.

11. The Helmholtz resonator as claimed in claim 9, further comprising:

a controller configured and arranged to drive the fluidic control device, the controller being configured and arranged to receive an input pulsation signal measured in said space.

12. The Helmholtz resonator as claimed in claim 5, further comprising:

a vortex generator arranged at an upstream end of the constriction and to which axially injected air can be applied via the axial air inlet, configured and arranged to alter the acoustic impedance and the swirl number of the constriction.

13. The Helmholtz resonator as claimed in claim 5, wherein:

said at least one resonator volume consists essentially of a single resonator volume;

the axial air inlet is arranged on a side of the resonator volume opposite the constriction; and the tangential air inlet is configured and arranged to inject air into the resonator volume approximately midway between the constriction and the axial air inlet.

14. The Helmholtz resonator as claimed in claim 5, wherein:

said at least one resonator volume comprises at least two resonator volumes with two associated constrictions, said at least two resonator volumes being fluidly connected one behind the other along the axis; and at least a first of said at least two resonator volumes comprises an axial air inlet configured and arranged to axially inject air, and a tangential air inlet configured and arranged to inject air in a circumferential direction with respect to the axis.

15. The Helmholtz resonator as claimed in claim 14, wherein a second of said at least two resonator volumes also comprises an axial air inlet configured and arranged to axially inject air, and a tangential air inlet configured and arranged to inject air in a circumferential direction with respect to the axis.

16. The Helmholtz resonator as claimed in claim 15, wherein both of said at least two resonator volumes comprise a vortex generator arranged at an upstream end of each constriction.

17. A combustion chamber comprising:

a combustion chamber having a space; and a Helmholtz resonator including at least one resonator volume configured and arranged to be connected to a space to be provided with damping, and a constriction in communication with the at least one resonator volume along an axis, wherein the constriction has a predetermined acoustic impedance; and means for adjusting the acoustic impedance of the constriction including an axial air inlet configured and arranged to inject air in the direction of the axis, and a tangential air inlet configured and arranged to inject air in a circumferential direction with respect to the axis;

wherein the constriction is in fluid communication with the space.

* * * * *